United States Patent [19]

Kiss

[11] Patent Number: 5,016,674

[45] Date of Patent: May 21, 1991

[54] ROD PLUG CAPS

[76] Inventor: Stephen J. Kiss, 371 Sapir St., Valley Stream, N.Y. 11580

[21] Appl. No.: 468,004

[22] Filed: Jan. 22, 1990

[51] Int. Cl.[5] ..... F16L 55/16

[52] U.S. Cl. ..... 138/91; 138/89; 165/71; 165/76

[58] Field of Search ..... 138/89, 91; 165/71, 165/76; 220/232

[56] References Cited

U.S. PATENT DOCUMENTS 595,189 12/1897 Mern ..... 285/177
685,561 10/1901 Bettermann ..... 138/91
1,607,428 11/1926 Boyd ..... 138/91
2,394,831 2/1946 Woods ..... 138/91

FOREIGN PATENT DOCUMENTS 4732 of 1887 United Kingdom ..... 138/91

*Primary Examiner*—James E. Bryant, III
*Attorney, Agent, or Firm*—Michael I. Kroll

[57] ABSTRACT

The present invention relates to rod plug caps for leaky tubes of a heat exchanger. The rod plug caps include a frustrum shaped tapered hollow plug having a top, a length, and a diameter. The diameter of the top being the widest of the plug. A plug nut is formed on the top of the plug. The plug nut and the plug are formed from one homogeneous piece of material.

2 Claims, 1 Drawing Sheet

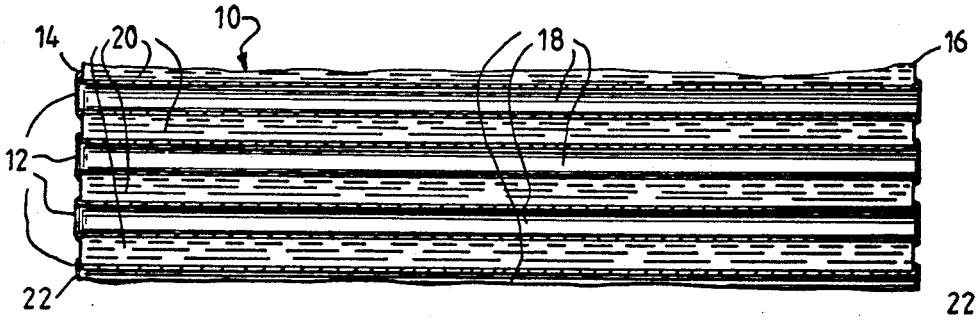
Fig. 1
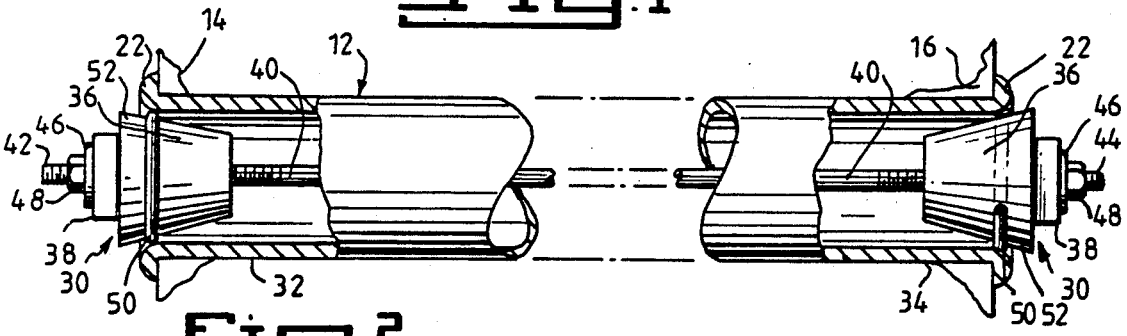
Fig. 2
Fig. 3
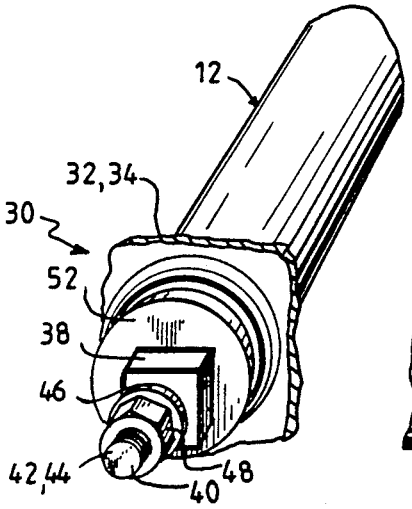
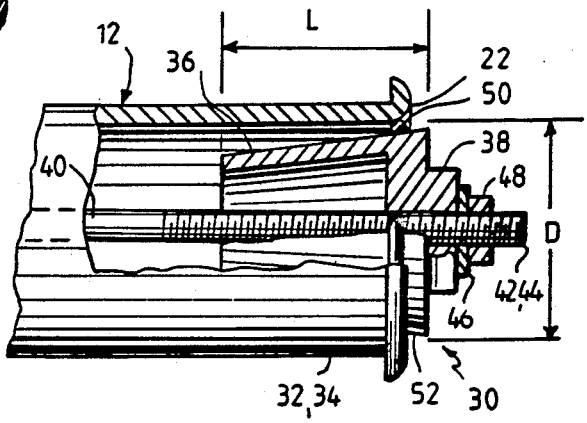
Fig. 4

ROD PLUG CAPS

BACKGROUND OF THE INVENTION

1. Field of the Invention:

The present invention relates to a heat exchanger.

More particularly, the present invention relates to a pair of rod plug caps that are used to stop leaks in a tube of a heat exchanger.

1. Description of the Prior Art:

Costly damage is done to a tube sheet of a heat exchanger when leaking tubes cannot be capped properly on the bead. In some areas, the caps are too large to install next to one another. The tubes then continue to leak causing the beads of the other tubes to be eaten away and making it impossible to cap the remaining tubes that ar leaking. At this point, the tube sheet must be repaired at a costly expense. At present, the standard way of capping a tube is from the outside of the bead if the bead still exists.

Numerous innovations for capping devices have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide rod plug caps that avoid the disadvantages of the prior art.

More particularly, it is an object of the present invention to provide rod plug caps for the ends of the tube which will seal and prevent the tube from leaking at the bead. The plug caps can be put side by side without interfering with one another. Further, the plug caps cannot be forced out by pressure, thus providing a safety factor. The use of the present invention reduces the amount of damage done to the tube sheet.

In keeping with these objects, and with others which will become apparent hereinafter, one feature of the present invention resides, briefly stated, in a plug for leaky tubes of a heat exchanger, comprising, a frustrum shaped tapered hollow plug having a top, a length, and a diameter, the diameter of the top being the widest of the plug, and a plug nut formed on the top of the plug, the plug nut and the plug are formed from one homogeneous piece of material.

When the rod plug caps are designed in accordance with the present invention, the rod plug caps for the ends of the tube seal and prevent the tube from leaking at the bead. The plug caps can be put side by side without interfering with one another. further, the plug caps cannot be forced out be pressure and thus providing a safety factor. The use of the present invention reduces the amount of damage done to the tube sheets.

In accordance with another feature of the present invention, it further comprises a threaded rod disposed longitudinally through the leaky tube.

Another feature of the present invention is that the threaded rod passes through the plug and the plug nut and then through a gasket washer and a rod nut.

Yet another feature of the present invention is that it further comprises an "0"-ring disposed around the widest part of the plug.

Still another feature of the present invention is that when the rod nut is tightened the "0"-ring is compressed from a round cross-section to an oval cross-section which provides a seal that prevents the water and the hot gas from mixing.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 1 is a side view of part of a conventional heat exchanger;

FIG. 2 is a side view with a partial cross-section and with parts cut away of the rod plug caps being used on a leaky tube;

FIG. 3 is a more detailed side view with a partial cross-section and with parts cut away of the rod plug caps shown in FIG. 2; and FIG. 4 is a front perspective view showing a rod plug cap installed in the end of a leaky tube.

LIST OF REFERENCE NUMERALS UTILIZED IN THE DRAWING

10—part of a conventional heat exchanger
12—plurality of tubes of the part of a conventional heat exchanger 10
14—first tube sheet of the part of a conventional heat exchanger 10
16—second tube sheet of the part of a conventional heat exchanger 10
18—hot gas from an oil or coal fire
20—water passing through the plurality of tubes 12
22—bead on each end of each of the plurality of tubes 12
30—rod plug caps of the present invention
32—first end of each of the plurality of tubes 12
34—second end of each of the plurality of tubes 12
36—tapered plug
38—nut of the tapered plug 36
40—threaded rod
42—first end of the threaded rod 40
44—second end of the threaded rod 40
46—gasket washer disposed on the threaded rod 40
48—nut disposed on the threaded rod 40
50—"O"—ring
52—wider section of the plug 36
D—diameter of the plug 36 at its widest section 52
L—length of the plug 36

DETAILED DESCRIPTION OF THE PREFERRED EMBODIMENT

FIG. 1 shows part of a conventional heat exchanger 10, containing a plurality of tubes 12, a first tube sheet 14, and a second tube sheet 16. As usual, each of the plurality of tubes 12 is displaced a distance from each other so that hot gas 18, from an oil or coal fire, can pass between the plurality of tubes 12 and heat the water 20 that passes through the plurality of tubes 12. Each of the plurality of tubes 12 contain a bead 22 at each end so that when the plurality of tubes 12 mate with the first tube sheet 14 and the second tube sheet 16, the plurality of tubes 12 will not fall through while also providing a mechanical seal between the plurality of tubes 12 and the first tube sheet 14 and the second tube sheet 16.

Referring now to FIGS. 2 through 4, the rod plug caps of the present invention are shown generally at 30 and are removably mounted in the first end 32 and in the second end 34 of each tube of the plurality of tubes 12.

The rod plug cap 30 of the present invention consists of a frustrum shaped hollow plug 36 having a length L and diameter D at its widest surface and further having a nut 38 on the hollow plug 36. The hollow plug 36 and the nut 38 are formed from one homogeneous piece of material, such as cast iron or galvanized steel, but it is not limited to it.

The hollow plug 36 fits into the first ends 32 and the second ends 34 of the plurality of tubes 12. A threaded rod 40 passes in the longitudinal direction within the pipe 12. The rod 40 has a first end 42 which passes through the hollow plug 36 and the nut 38 and a second end 44 which passes through the other hollow plug 36 and the other nut 38. As the rod 40 emerges from the plug 36, a gasket washer 46 is placed on the rod 40 and a nut 48 is screwed on to the rod 40. Another nut 48 is screwed on to the rod 40. The nut 48 is tightened, as the nut 38 is held from turning by a wrench or the like.

As shown in FIGS. 2 and 3, an "0"-ring 50 with a round cross-section is disposed around the substantially widest surface 52 of the plug 36 within the tube 12 on the interior surface of the tube 12. As the nut 48 is tightened, the "0"-ring 50 compresses between the widest surface 52 of the plug 36 and the interior surface of the first end 32 of the tube 12, and seals the tube 12 from the inside of the tube 12 as it forms an oval cross-section.

The "0"-ring 50 with a round cross-section is also disposed around the substantially widest surface 52 of the other plug 36 within the tube 12 on the interior surface of the tube 12. As the nut 48 is tightened, the "0"-ring 50 compresses between the substantially widest surface 52 of the other plug 36 and the interior surface of the second end 34 of the tube 12, and seals the tube 12 from the inside of the tube 12 as it forms an oval cross-section.

It will be understood that each of the elements described above, or two or more together, may also find a useful application in other types of constructions differing from the type described above.

While the invention has been illustrated and described as embodied in a rod plug cap, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A plug for leaky tubes of a heat exchanger, said leaky tubes having ends with outside surfaces and diameters, comprising:

(a) a frustrum shaped tapered hollow plug having a top, a length, and a diameter at the top, said diameter of said top being the widest of said plug;

(b) a plug nut formed on said top of said plug, said plug nut and said plug being formed from one homogeneous piece of material;

(c) a threaded rod disposed longitudinally through the leaky tube, said threaded rod passing through said plug and said plug nut and then through a gasket washer and a rod nut; and (d) an "O"-ring disposed inside the leaky tube around said plug, said plug diameter at the top being less than the outside diameter of the end of the tube so that nothing extends or protrudes past the outside surface of the end of the tube and therefore, allowing the stopped tubes to be disposed in close proximity to each other and to the other tubes of the heat exchanger.

2. A plug as defined in claim, 1, wherein when said rod nut is tightened said "O"-ring is compressed from a round cross-section to an oval cross-section, which provides a seal that prevents the water and the hot gas from mixing.

* * * * *